United States Patent [19]

Goldammer et al.

[11] 4,382,316

[45] May 10, 1983

[54] METHOD AND APPARATUS FOR OPENING AND MIXING FIBER BALES

[75] Inventors: Georg Goldammer, Gaimersheim; Gunter Mahrt; Joachim Dammig, both of Ingolstadt, all of Fed. Rep. of Germany

[73] Assignee: Schubert & Salzer, Maschinenfabrik Aktiengesellschaft, Ingolstadt, Fed. Rep. of Germany

[21] Appl. No.: 193,162

[22] Filed: Oct. 2, 1980

[30] Foreign Application Priority Data

Oct. 2, 1979 [DE] Fed. Rep. of Germany ..... 2939890

[51] Int. Cl.[3] ..... D01G 7/06

[52] U.S. Cl. ..... 19/81; 19/145.5

[58] Field of Search ..... 19/80 R, 81, 145.5

[56] References Cited

U.S. PATENT DOCUMENTS 3,577,599 5/1971 Goldammer ..... 19/145.5

3,806,990 4/1974 Goldammer et al. ..... 19/145.5

4,107,820 8/1978 Mahrt et al. ..... 19/81

*Primary Examiner*—Louis Rimrodt

*Attorney, Agent, or Firm*—Julian W. Dority

[57] ABSTRACT

A method an apparatus for opening and mixing the fibers from a plurality of bales according to a predetermined mixture. The device includes tongs-like gripper means which press into the fiber bales for removing fibers therefrom. A measuring means and a control means determine the width of opening of the gripper means. A control circuit is provided for receiving a signal representing the weight of the first pick-up from a particular bale and the weight of the fibers deposited in a receiver container. When the sum of these signals is equal to the preset desired weight of the fibers that are to be deposited in the receiver container, a compared signal is produced causing the tongs on successive pick-ups to be opened to a lesser degree. As a result, a high degree of accuracy is obtained when mixing to a predetermined ratio while maintaining a high production output.

6 Claims, 6 Drawing Figures

FIG.4
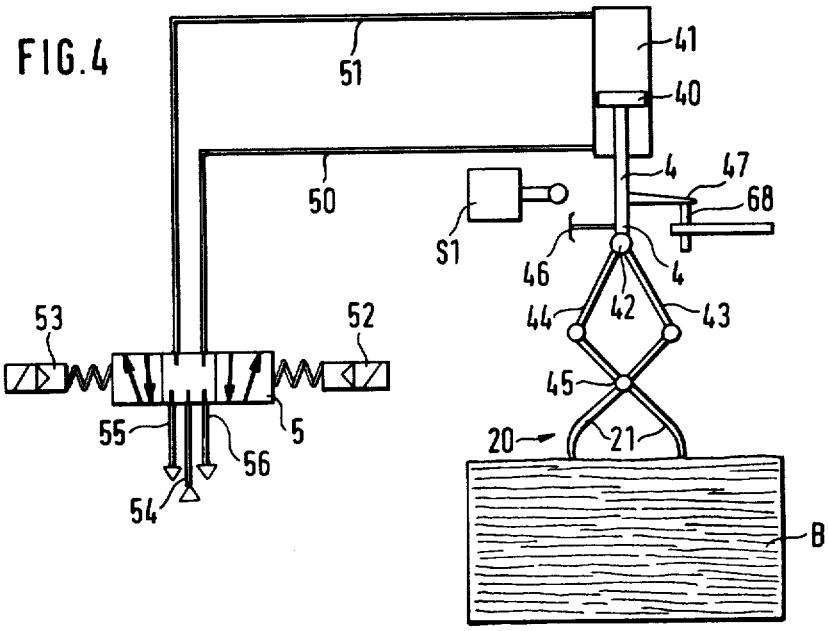
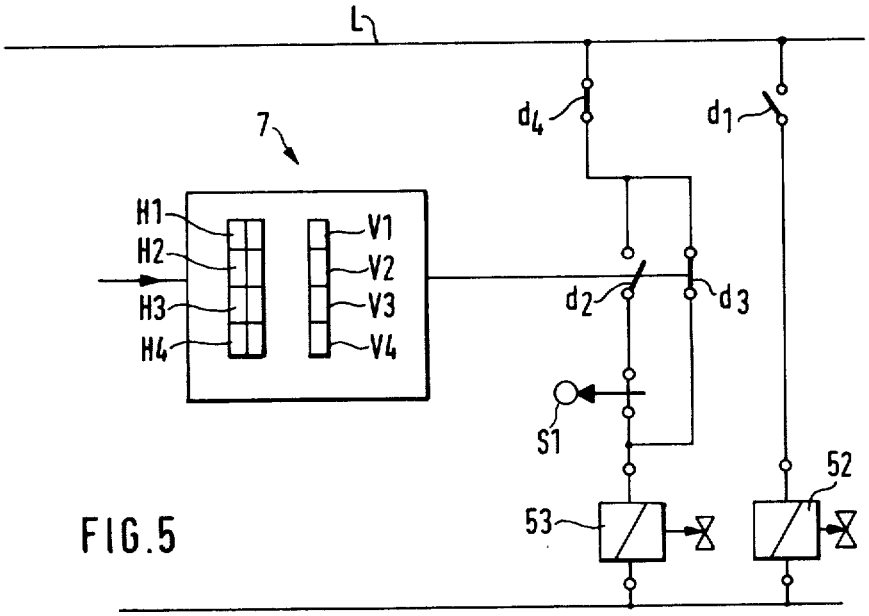
FIG.5

METHOD AND APPARATUS FOR OPENING AND MIXING FIBER BALES

BACKGROUND OF THE INVENTION

The present invention relates to a method for opening and mixing fiber bales in accordance with predetermined proportions in the mixture, wherein the fiber material is removed from the bales by being taken off in individual amounts and the amount removed is measured, and apparatus for carrying out the method.

It is known for fiber material to be removed from bales by being taken off in individual amounts by means of a gripper device for the purposes of putting together fiber mixtures with predetermined proportions therein. The amounts of fibers which are removed from the bales in accordance with the relationship between the constituents of the mixture are collected and measured in an intermediate container which is in the form of a weighing device (U.S. Pat. No. 3,577,599).

In order to achieve a high production output, with the maximum accuracy in regard to maintaining the predetermined proportions in the mixture even when, on the one hand, very small amounts and, on the other hand, amounts which are large in relation thereto have to be taken from the bales to be mixed for the purposes of forming a mixture from different amounts of fibers, it has already been proposed that the amount of fiber which is taken from the bale in each gripping operation should be adapted to the magnitude of the respective constituent of the mixture. Adjustable limit means are associated with the drive arrangement of the gripper for controlling the ratio of the fibers removed from the bales. The limit switch means determines the width that the gripper means is opened and is actuated by a control device which determines the proportions of the constituents of the mixture (U.S. Pat. No. 4,107,820).

This arrangement makes it possible to operate, in the individual fiber supply stations which contain the respective constituents of the mixture, in accordance with the magnitude of the respective proportions to be supplied thereby with the gripper means set to a width of opening which is adapted to the respective constituent of the mixture. By adjustment of the limit means, the gripper means is set to a wide width of opening when dealing with fiber which forms a large proportion of the mixture while the gripper means is set to a small width of opening when dealing with a small constituent. If there is a plurality of fiber supply stations and if such stations are required to supply different amounts of fiber to form the respective proportions of the mixture, the number of limit means corresponds to the number of constituents of the mixture or fiber supply stations so that each fiber supply station has associated therewith a different width of opening of the gripper device which is adapted to the respective constituent of the mixture at that station. As an alternative, in accordance with the known proposal, the width of opening can be limited to two widths if there is considerable difference only between the constituents at two fiber supply stations while if there are other constituents, those other constituents are close to the above-mentioned two constituents. This system, however, also retains the principle of operating with a wide width of opening in relation to a fiber supply station with a constituent forming a large proportion of the mixture, and with a small width of opening when operating at a fiber supply station giving a constituent forming a small proportion of the mixture.

However, with this mode of operation, it may occur that when removing large amounts of fiber with the gripper means set to a correspondingly wide width of opening at a fiber supply station, a large amount of fiber may again be taken from a bale although the constituent of the mixture has almost reached its desired weight. In this case, the actual weight of the constituent will exceed the desired weight to an inadmissible extent.

SUMMARY OF THE INVENTION

The problem of the present invention is further to enhance the degree of accuracy in observing the predetermined proportions of the mixture while maintaining a high production output.

According to the invention, this problem is solved in that an initial weight is first associated with each constituent of the mixture and that, when the desired weight of the constituent, less the initial weight, is reached, the amount of fiber taken from the bale is reduced until the desired weight is reached, whereupon the amount of fiber taken from the bale is increased again at the beginning of the operation of removing the next constituent of the mixture.

The apparatus for carrying out the method comprising a tongs-like gripper means which presses into the fiber bales, a measuring means and a control means for determining the width of opening of the gripper means. The control means establishes the desired weight of a constituent of the mixture, less an initial weight, and when said weight is reached, switches the wide width of opening of the gripper means over to a small width of opening.

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein:

BRIEF DESCRIPTION OF THE DRAWINGS

FIG. 4 shows a view from the front of the gripper means with drive means and associated limit means;

FIG. 5 shows a circuit diagram with control means; and

DESCRIPTION OF THE PREFERRED EMBODIMENT

Figure 1:
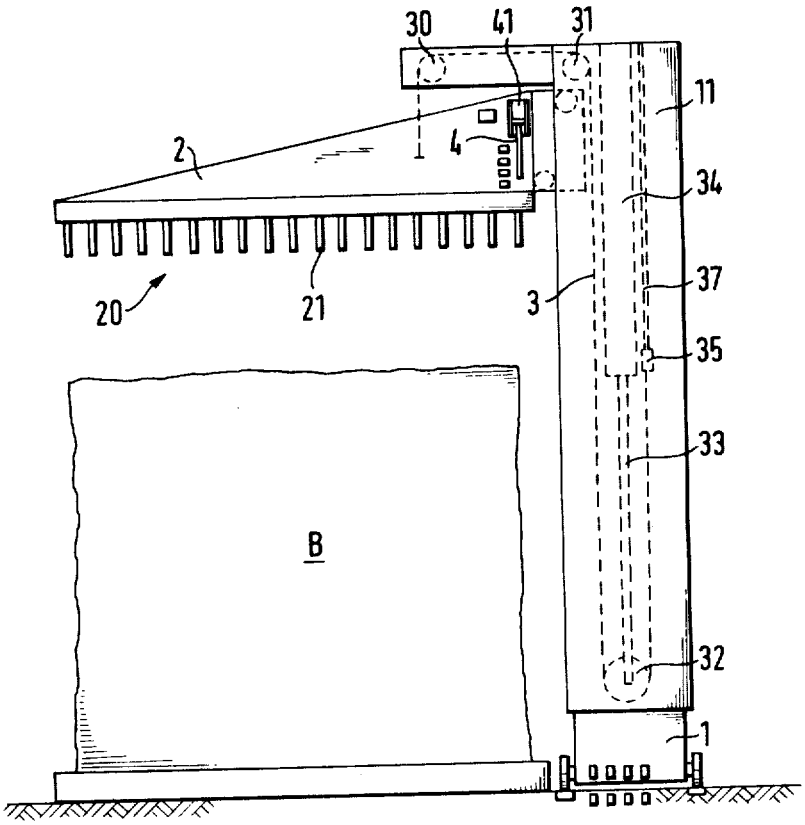
FIG. 1 shows a view from the front of an apparatus for opening fiber bales having a gripper means.
Figure 3:
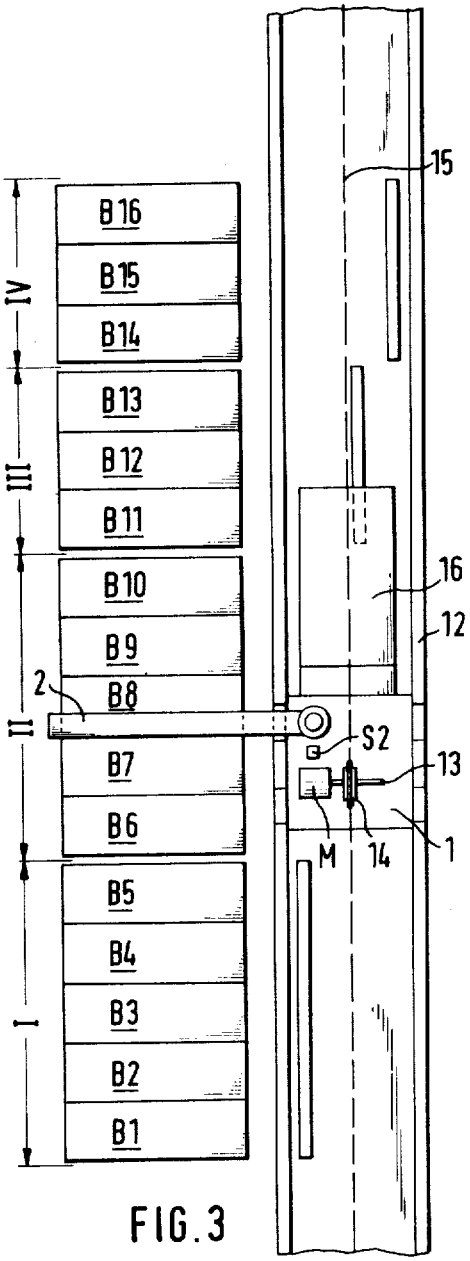
FIG. 3 shows a plan view of the FIG. 1 apparatus, which is movable along a row of bales.

A column-like carrier 11 which is secured to a carriage 1 carries a gripper arm 2 with gripper fingers 21 which are arranged in pairs and which are generally denoted as gripping means 20 and which, as will be described in greater detail hereinafter, are opened and closed with a tongs-like movement (FIG. 1). The gripper arm 2 is movable in a vertical direction so that the gripping means 20 can be brought into engagement with a bale B and lifted away therefrom again. The vertical movement of the gripper arm 2 with the gripping means 20 is produced by way of a traction means, for example, a chain 3 which is secured to the gripper arm 2 and which is guided over guide rollers 30 and 31. A chain wheel 32 secured to a piston rod 33 engages the chain 3. The piston of the piston rod 33 is slidable in a cylinder 34 and is actuated pneumatically or hydraulically. The other end of the chain 3 is secured to a housing 35 which is displaced by the presence of a spring 36 on a rod 37 when the tension in the chain 3 is relaxed when the gripping means 20 penetrates into the fiber bale B (FIG. 3). The rod 37 is fixed on the column-like carrier 11. A switch SE which is displaceable in a vertical direction is arranged stationarily in the vicinity of the housing 35 which has a metal base 38. Sensing means of this kind for determining the depth of penetration of the gripping means into the bale by way of the chain tension are known in different forms so that the present form is shown only by way of example.

The removal device is movable along a row of fiber bales B1, B2, . . . B16 on rails 12 (FIG. 3). It is driven by a reversible traction motor M having a drive shaft 13 on which a chain wheel 14 is secured. The chain wheel 14 engages into a chain 15 which runs parallel to the rails 12. In the present example, the fiber bales B1, B2 . . . B16 form four fiber supply stations I, II, III and IV, each of the fiber supply stations containing a given kind of fiber, which fibers are to be mixed in predetermined proportions. The respective quantities of fiber corresponding to the above-mentioned proportions of the mixture are removed successively from the individual fiber supply stations I, II, III and IV by means of the gripping means 20 in known manner in accordance with a predetermined program, and dropped into a receiving container 16 which is secured to the column-like carrier 11 and which is in the form of a weighing device. For this purpose, the gripper arm 2 with the gripping means 20 is pivotal from a position above the fiber bales to a position above the receiving container 16.

The tongs-like opening and closing movements of the gripper fingers 21 forming the gripping means 20 are produced as shown in FIG. 4, by a piston rod 4 whose piston 40 is slidable in a cylinder 41 and is actuated pneumatically or possibly also hydraulically. The connection between this actuating arrangement which is disposed in the gripper arm 2, and the gripping means 20, is such that the piston rod 4 engages a rod 42 on which bars 43 and 44 are disposed. The bars 43 and 44 are pivotally connected to the gripper fingers 21 which, in turn, are mounted pivotally about an axis member 45 which is secured to the gripper arm 2 and which extends over the length thereof. Compressed air is supplied to the cylinder 41 alternately through two conduits 50 and 51 and is controlled by an electromagnetic valve 5 with solenoids 52 and 53. The valve 5 is connected to a compressed air source (not shown) by way of a conduit 54. Conduits 55 and 56 lead from the electromagnetic valve 5 into the open air.

The actuating device for opening and closing the gripping means 20 or the gripper fingers 21, in the present case being the piston rod 4, has associated therewith a stationary limit stop 68 and a limit swtch S1, which limit the downward movement of the piston rod 4 and thus determine the width of opening of the gripping means 20 or the gripper fingers 21. The limit stop 68, against which a sensing stop 47 secured to the piston rod 4 comes to bear in the course of the downward movement of the piston rod 4, provides for establishing a wide width of opening of the gripping means 20 and the limit switch S1 provides for establishing a small width. The limit switch S1 is actuated by a switching cam 46 disposed on the piston rod 4.

Figure 2:
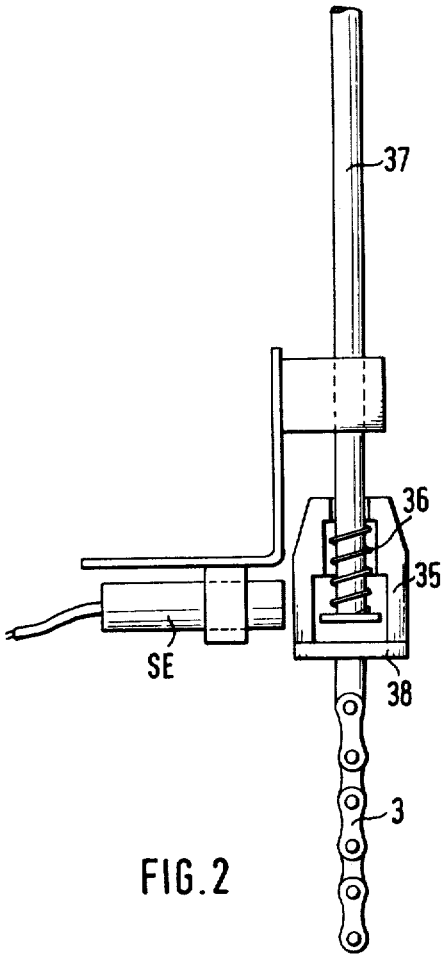
FIG. 2 shows a view on an enlarged scale of a sensor.

As shown in FIG. 5, the solenoid 52 of the valve 5 can be connected to the current-carrying line L by way of a contact means d1 and the solenoid 53 can be connected to the line L by way of contact means d2, d3 and d4 and the limit switch S1. The contact means d1 is actuated by the switch SE (FIG. 2). As will be described hereinafter, opening and closing of the contact means d2 and d3 is effected by an electrical control device 7 with preselection switches H1 to H4 and V1 to V4 (FIGS. 5 and 6) in dependence on the weight of material in the weighing device 16. A switching means S2 arranged on the carriage 1 acts on the contact means d4.

The mode of operation of the apparatus will now be described with reference to FIGS. 1 to 6. Firstly, the desired weight in respect of the amount of fiber which is to be removed from the individual fiber supply stations I to IV, in accordance with the predetermined proportions in the mixture, is set at the preselection switches H1, H2, H3 and H4. In addition, an initial or preliminary weight is set by means of the preselection switches V1, V2, V3 and V4, for each of the four fiber supply stations. Let it be assumed that the desired weight of the amount of fiber which is to be removed at the fiber supply station I is 10 kg and an initial weight of 2 kg is associated with the measurement value of the weighing device, being the value which corresponds to the respective weight of material in the weighing device. The preselection switches are controlled by a control arrangement 70 (see FIG. 6) which, in turn, receives control pulses from the weighing device.

The carriage 1 is in the region of the fiber supply station I in respect of which the desired weight of the amount of fiber to be removed has been set at the preselection switch H1. The control arrangement 70 which, after the preceding operation of emptying the receiving container 16, receives a corresponding control pulse, activates the preselection switch H1, whereby the set desired weight is supplied to a memory means 71 (see FIG. 6).

The gripper arm 2 is in the position shown in FIG. 1. The contact means d1 is opened as the chain 3 is tensioned and the metal base plate 38 of the housing 35 is thus outside its range of action on the switch SE. When the apparatus is switched on, the gripper arm 2 pivots to a position over the receiving container 16 which is formed as a weighing device. When this happens, a cam (not shown) which is arranged at the pivot axis of the gripper arm 2 actuates the switching means S2 (see FIG. 3) in the outwardly pivoted condition so that the contact means d4 (see FIG. 5) is closed. This, therefore, forms a current-conducting connection between the line L and the solenoid 53, by way of the closed contact means d4 and d3. The solenoid 53 is thus energized whereby compressed air flows through the conduits 54 and 51 into the cylinder 41 and urges the piston 40 with piston rod 4 downwardly. When this happens, the gripper fingers 21 pivot about the axis member 45 and open. The opening movement is terminated when the sensing stop 47 strikes against the limit stop 68. Although in this downward movement of the piston rod the swtiching arm 46 does in fact actuate the limit switch S1, nonetheless, this actuation has no effect on the solenoid 53 as the contact means d2 is open.

The gripper arm 2 now pivots over a bale B, the contact means d4 opening. The piston of the piston rod 33 (see FIG. 1) is then actuated with compressed air in such a way that the piston rod 33 moves upwardly and the gripper arm 2 with the gripper fingers 21 opened to a large width, moves down onto the bale B. When the gripper fingers 21 have penetrated into the bale to a predetermined depth and the chain 3 has become slackened in accordance with the above-mentioned predetermined depth, the base plate 38 of the housing 35 which is now moved on the rod 37 actuates the switch SE (see FIG. 2) whereby the contact means d1 is closed. This causes current to be supplied to the solenoid 52 of the valve 5 so that the solenoid 52 is energized and compressed air accordingly flows through the conduits 54 and 50 into the cylinder 41 and drives the piston 40 upwardly, while the compressed air in the upper part of the cylinder 41 escapes through the conduits 51 and 55. The upward movement of the piston rod 4 closes the gripper fingers 21.

The gripper arm 2 with the fiber material held by the gripper fingers 21 is lifted from the bale B by the piston rod 33 being moved downwardly by a flow of compressed air into the cylinder 34. The chain 3 tightens again so that the metal base plate 38 moves away from the switch SE and the contact means d1 is opened. The gripper arm 2 is then pivoted over the receiving container 16 of the weighing device; in that case, at the end of the pivotal movement, the switching means S2 is actuated and the contact means d4 is closed. This results in energization of the solenoid 53 and thus causes opening of the gripper fingers 21 in the above described manner so that the fiber material falls into the receiving container 16 which is in the form of the weighing device and which is moved downwardly by the weight of fiber material which is referred to hereinafter as the filling weight.

The resulting mechanical parameter is measured by means of a potentiometer or other suitable sensing means and supplied to an adding means 72 in the form of an electrical measurement value, for example, as an anlog signal which is proportional to the filling weight. In the weighing operation, the preselection switch VI at which the initial weight in respect of the fiber supply station I is set is activated by way of the control arrangement 70 so that the initial weight also passes into the adding means 72 and is there added to the measurement value of the filling weight in the receiving container. If the filling weight is supplied to the adding means 72 in the form of an analog signal, it will be appreciated that the digital value of the initial weight is also converted into an analog signal, in a digital-analog converter which is connected upstream of the adding means. The sum of the two weights is compared to the desired weight in a comparison stage 73. When the measurement value in respect of the filling weight, increased by the initial weight, reaches the above-mentioned desired weight, the comparison stage passes a control pulse to the control arrangement 70 which, on the one hand, then blocks the input to the adding means 72, being the input associated with the initial weight and, on the other hand, opens the contact means d3 and closes the contact means d2.

If, as indicated above for example, an initial weight of 2 kg is associated with a constituent of the mixture or its desired weight of 10 kg, then the control pulse is produced when the filling weight in the receiving container is 8 kg which corresponds to the desired weight less the initial weight.

As in the outwardly pivoted condition of the gripper arm 2 as described above the contact means d4 is closed, a current-conducting connection is made between the line L and the solenoid 53 by way of the contact means d4 and d2 and the closed contact of the limit switch S1. Energization of the solenoid 53 causes compressed air to flow through the conduits 54 and 51 into the cylinder 41 to urge the piston 40 downwardly so that the gripper fingers 21 open. However, the downward movement of the piston 40 is terminated at the moment that the switching cam 46 actuates the limit switch S1 and opens the contact thereof so that the gripper fingers 21 open to only a small width. The gripper arm is again lowered onto a bale B in the fiber supply station I in the above described manner, and now removes therefrom as a result of the small width of opening of the gripper fingers 21, only a small amount of fiber which is again dropped into the receiving container 16 forming the weighing device. As the initial weight is no longer passed to the adding means 72 in the subsequent weighing operation, the actual filling weight in the receiving container 16 is compared to the desired weight; and when the weight in the container reaches the desired weight, a switching pulse is applied to the control arrangement 70 which thereupon actuates the preselection switches H2 and V2 at which the desired weight and the initial weight in respect of the fiber supply station II are set. The carriage 1 now moves to station II and the above described operation of removing material is repeated at station II. In station II, as also in subsequent fiber supply stations III and IV, the fiber material removed is added to the material already in the receiving container 16 so that at the end all constituents of the mixture are in the receiving container 16 in the predetermined amount.

The above described mode of operation makes it possible to operate with the gripper fingers set to a wide degree of opening until the desired weight less the initial weight is reached, and then to operate with the gripper fingers at a small width of opening for the residual weight corresponding to the initial weight. This thus provides, on the one hand, for a high production capacity and, on the other hand, for a high degree of accuracy in producing the mixture.

Figure 6:
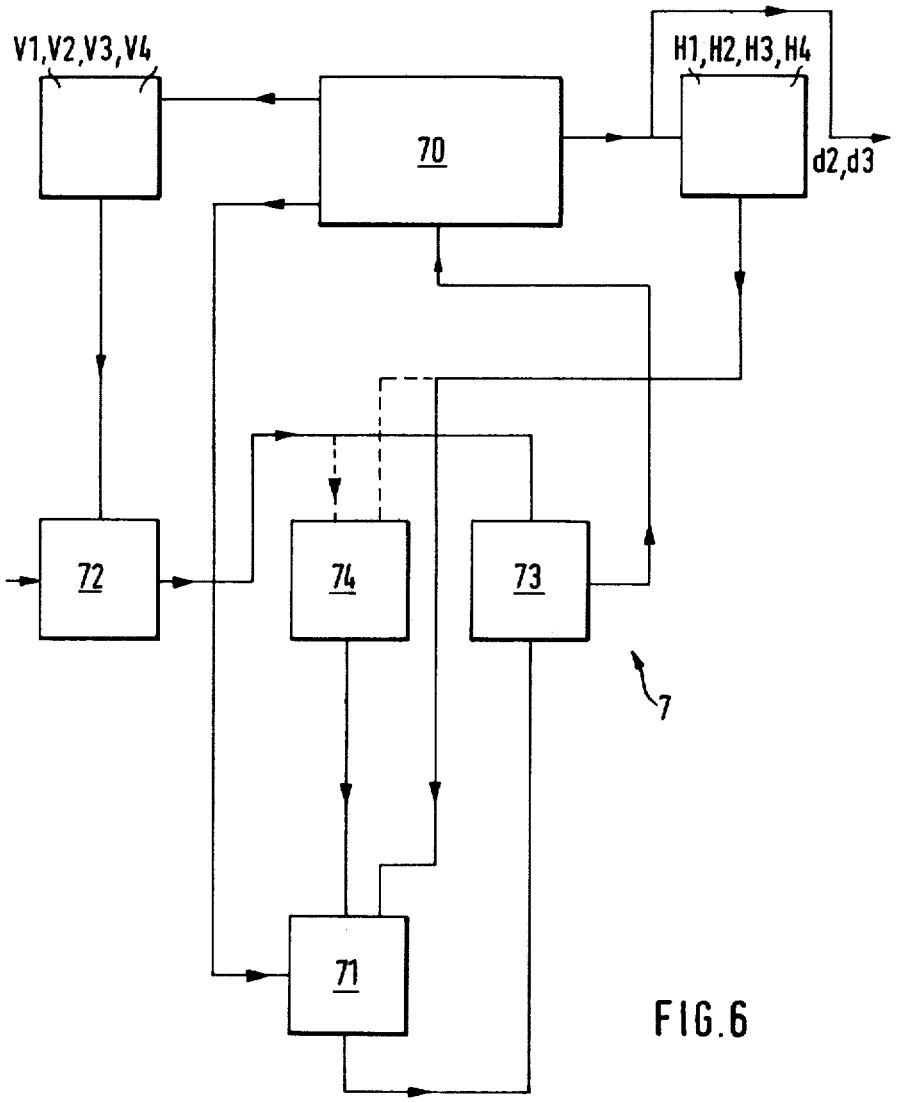
FIG. 6 shows a block circuit diagram of the control device.

In order further to increase the degree of accuracy in producing the mixture, as shown alternatively in FIG. 6, a full adding means 74 is connected to the input of the memory means 71. The desired weight and the filling weight are added in the full adding means 74 when the filling weight has reached the desired weight. The resulting total weight is inputted into the memory means 71. In this way, a new 'zero point' is provided for each fiber supply station so that any variation in weight from the desired weight in regard to a constituent of the mixture is not transmitted to the respective next fiber supply station. If, for example, the assumed desired weight of 10 kg is exceeded by one kg in the fiber supply station I; and if the desired weight for the constituent of the mixture in fiber supply station II is 13 kg, the addition of these values now gives a desired weight of 24 kg which is applied to the memory means 71 and the comparison stage 73 connected to the output thereof. Therefore, as intended, 13 kg of fiber material is to be taken from the bale in the fiber supply station II until the above indicated desired weight is reached.

The degree of accuracy in producing the mixture can also be further increased by associating with the control device a computer unit which computes the relationship between the filling weight attained and the set desired weight and which increases the set desired weight of the subsequent fiber supply stations by the computed value.

The method which is described above, for example, with reference to a gripping means and in which an initial weight is associated with each constituent of the mixture and the amount of material taken from a bale is reduced when the filling weight reaches the desired weight of the constituent of the mixture, less the initial weight, may be the subject of modifications, like also the apparatus for carrying out the method. Thus, instead of increasing the filling weight by an initial weight or reducing the desired weight by said initial weight in respect of each constituent of the mixture, it is possible to establish an initial weight which is below the desired weight, and the amount of material taken from a bale is reduced when that weight is reached. This mode of operation follows the disclosed principle and is in accordance with the solution according to the invention.

In addition, the above described control device which establishes the desired weight of a constituent of the mixture, less an initial weight, or which also establishes an initial weight which is determined in respect of a constituent of the mixture and which is below the desired weight, which control device switches the gripping means over from a condition of wide opening of the fingers to a condition of small opening of the fingers when the filling weight reaches the desired weight less the initial weight or the initial weight when the matter is below the desired weight, can also be replaced by other means, for example, by microprocessors.

While a preferred embodiment of the invention has been described using specific terms, such description is for illustrative purposes only, and it is to be understood that changes and variations may be made without departing from the spirit or scope of the following claims.

What we claim is:

1. An apparatus for mixing fiber bales in accordance with predetermined proportions in a mixture wherein fiber material is removed from the bales with tongslike gripping means and deposited in a receiving container, and measuring means and a control means are provided for controlling the width of opening of the gripping means comprising:

said control means reducing the width of opening of said gripping means (20) from a wide width to a smaller width opening for removing said fibers from said bale in a smaller amount upon the desired weight of fibers less an initial pickup weight of fibers being removed from said bale.

2. Apparatus according to claim 1 further comprising: said control means (7) includes preselection switches (H1, H2, H3, H4) for the desired weight and preselection switches (V1, V2, V3 and V4) for an initial weight, and also has an adding means (72) into which the values of the initial weight and the filling weight of the receiving container (16) can be introduced, and a memory means (71) connected to the desired weight preselection switches (H1, H2, H3 and H4) and a comparison stage (73) which is connected between said memory means (71) and said adding means (72) and which is connected to a control arrangement (70) for actuating limit means (68, S1) and the preselection switches (H1, H2, H3, H4, V1, V2, V3, and V4).

3. Apparatus according to claim 2 further comprising: a full adding means (74) connected to said adding means (72) and said desired weight preselection switches (H1, H2, H3 and H4) being connected upstream of said memory means (71) wherein, after a respective constituent of the mixture has been removed, the corresponding measurement value in respect of the filling weight of the receiving container (16) and of the desired weight of a subsequent constituent of the mixture is introduced into said full adding means, and the determined total weight is fed to said memory means (71) and said comparison stage (73) which is disposed downstream thereof and which is connected to the control arrangement (70).

4. Apparatus according to claim 1 further comprising: means for determining the relationship between the filling weight which has been reached and the desired weight associated with the control means (7).

5. An apparatus for removing fibers in a plurality of pick-ups from a bale using tongs-like grippers and depositing said fibers in a receiver container wherein control means cause said grippers to open to a lesser extent as the total weight of fibers deposited in said receiving container reaches a predetermined weight minus the weight of the initial pick-up of the fibers comprising:

switch means set to a value representing the predetermined desired weight of fibers to be deposited in said receiving container, initial weight switch means set to a value representing the predetermined desired weight of said initial pick-up of said fibers, comparator means, means for generating a signal representing the weight of fibers deposited in said receiving container, adding means for adding said signal representing the weight of fibers deposited in said receiving container with said value set in said initial weight means and generating a signal representing the sum of said signals, comparator means comparing said signal representing the sum of said signals with said value set in said switch means representing predetermined desired weight and generating a compared signal when said sum signal reaches said value representing said predetermined desired weight to be deposited in said receiving container, and means for feeding said compared signal to said control means causing said gripper means to open to a lesser extent on subsequent pick-ups.

6. The apparatus as set forth in claim 5 further comprising:

said control means preventing said value set in said switch means from being added to said signal representing the weight of fibers deposited in said receiving container upon receiving said compared signal, and said comparator means generating another compared signal when said signal representing the weight of fibers deposited in said receiving container equals said value representing the predetermined desired weight of fibers to be deposited in said receiving container.

* * * * *